US006544099B2

(12) United States Patent
Shafik

(10) Patent No.: US 6,544,099 B2
(45) Date of Patent: Apr. 8, 2003

(54) SUSPENDABLE TALKING APPARATUS

(76) Inventor: Joseph Shafik, 3409 Holly Rd., Annandale, VA (US) 22003

( * ) Notice: Subject to any disclaimer, the term of this patent is extended or adjusted under 35 U.S.C. 154(b) by 0 days.

(21) Appl. No.: 09/765,286

(22) Filed: Jan. 22, 2001

(65) Prior Publication Data

US 2002/0142700 A1 Oct. 3, 2002

(51) Int. Cl.[7] ..... A63H 5/00

(52) U.S. Cl. ..... 446/404; 446/397; 273/454; 482/83; D21/787

(58) Field of Search ..... 446/404, 297, 446/298, 299, 300, 301, 302, 397; 273/1.5 R, 1.5 A, 57.2, 371; 482/83, 84, 85, 86, 87; D21/787, 404

(56) References Cited

U.S. PATENT DOCUMENTS

| | | | | | |
|---|---|---|---|---|---|
| 3,073,058 | A | | 1/1963 | Lemelson | |
| 3,933,354 | A | | 1/1976 | Goldfarb | |
| 4,268,030 | A | * | 5/1981 | Richards | 446/226 |
| 4,378,577 | A | * | 3/1983 | Chamberlin | 235/462.18 |
| 4,534,557 | A | * | 8/1985 | Bigelow et al. | 273/446 |
| 4,721,302 | A | * | 1/1988 | Murphy | 473/442 |
| 4,761,005 | A | * | 8/1988 | French et al. | 273/454 |
| 4,809,335 | A | | 2/1989 | Kumsey | |
| 4,824,107 | A | * | 4/1989 | French | 273/454 |
| 4,834,375 | A | | 5/1989 | Elstein | |
| 4,974,833 | A | | 12/1990 | Hartman | |
| 5,280,905 | A | | 1/1994 | Micco | |
| 5,326,094 | A | * | 7/1994 | Quinn | 273/371 |
| 5,605,336 | A | | 2/1997 | Gaoiran | |
| 5,628,713 | A | * | 5/1997 | Wilkinson | 482/51 |
| D385,605 | S | * | 10/1997 | Ferrara | D21/787 |
| 5,674,157 | A | * | 10/1997 | Wilkinson | 482/27 |
| 5,690,582 | A | | 11/1997 | Ulrich | |
| 5,695,381 | A | | 12/1997 | Truchess | |
| 5,733,193 | A | * | 3/1998 | Allard et al. | 463/8 |
| 5,795,213 | A | | 8/1998 | Goodwin | |
| 5,803,877 | A | | 9/1998 | Franey | |
| 5,810,685 | A | * | 9/1998 | Willner et al. | 273/335 |
| 5,857,939 | A | | 1/1999 | Kaufman | |
| 5,895,308 | A | | 4/1999 | Spector | |
| 6,273,421 | B1 | * | 8/2001 | Thalheimer et al. | 273/161 |
| 2002/0095952 | A1 | * | 7/2002 | Kelly | 63/3 |

* cited by examiner

*Primary Examiner*—Derris H. Banks
*Assistant Examiner*—Urszula Cegielnik
(74) *Attorney, Agent, or Firm*—Tom Hamill, Jr.

(57) ABSTRACT

A system, apparatus and article of manufacture which comprises a portable, sensor-activated, suspendable electronic device which produces human speech when stimulated. The device may be used in conjunction with punching bags or may also be worn about the belt of the user. The device is programmed with plural sounds and phrases which are played through an on-board speaker. It is equipped with facility for recording sounds and phrases. Sounds are toggled to be played by built-in sensors which may be sensitive to vibration, touch, light or other means. Sounds and phrases may be related to specific activity modes in which the user employs the apparatus. All sounds can be played, either serially or randomly through the self-contained speaker. Sounds, which may be motivational in nature, can be related to a specific user function, such as jogging, working out, boxing, punching a punching bag or other desired activity.

10 Claims, 3 Drawing Sheets

SUSPENDABLE TALKING APPARATUS

BACKGROUND OF THE INVENTION

1. Field of the Invention

The present invention relates generally to electronic amusement devices, and more particularly to a motion sensitive, suspendable electronic amusement device especially adapted to allow for playing both pre-recorded sounds and sounds recorded by the user. The function of the inventive device is to motivate, amuse and stimulate the user by simulating speech associated with a specific activity, especially motivational speech related to punching, jogging or working out.

2. Description of the Prior Art

Speech synthesizers or other sound producing means and their incorporation into amusement devices, toys and the like are known in the art.

U.S. Pat. No. 4,809,335 issued to Rumsey discloses a speech unit for producing preselected words or phrases based on the orientation of a toy doll or figure. A gravity sensing means produces an output corresponding to the orientation of the sensing means with respect to gravity. The output of the sensing means is coupled to a speech synthesizer which produces an output based on transitions from one orientation of the sensing means to a second orientation.

U.S. Pat. No. 5,695,381 issued to Truchess discloses a bear or baby doll that laughs or sings a nursery song when bounced or dandled is disclosed. A particular area on the rump of the doll is pressure sensitive and produces the given sound when a pressure level is detected in that particular area that is within a range of pressure levels produced when the doll's rump contacts the child's knee in a gentle bounce.

U.S. Pat. No. 5,795,213 issued to Goodwin discloses a portable toy having an audio signal producer is provided with a book. The book has a plurality of numbered pages containing parts of a story. The toy is provided with a plurality of pressure switches designating different pages of the book.

The foregoing body of prior art indicates it to be known to use speech synthesizers or other sound producing means and incorporate them into amusement devices, toys and the like; however, the provision of a such a device which can be suspended from a person, a toy, an object or other amusement device by the user himself is not contemplated. Nor does the prior art described above teach or suggest a suspendable sound producing device which may be used by individuals in a variety of activities designated explicitly by the user with means for playing user recorded sounds, in addition to playing pre-recorded sounds. The foregoing disadvantages are overcome by the unique talking box device of the present invention as will be made apparent from the following description thereof. Other advantages of the present invention over the prior art also will be rendered evident.

SUMMARY OF THE INVENTION

The present invention provides a system, apparatus and article of manufacture which comprises a portable, sensor-activated, suspendable electronic device which produces human speech when stimulated. The device may be used in conjunction with punching bags and may also be worn about the belt of the user. The device is programmed with plural sounds and phrases which are played through an on-board speaker. It is equipped with facility for recording sounds and phrases. Sounds are toggled to be played by built-in sensors which are sensitive to vibration, touch, light or other means. Sounds and phrases may be related to specific activity modes in which the user employs the apparatus. All sounds are played through the self-contained speaker. Sounds, which may be motivational in nature, can be related to a specific user function, such as jogging, working out, boxing, punching a punching bag or other desired activity.

The electronics may be packaged in a housing which assumes the appearance of a punching bag, either a peanut bag or a heavy bag. The housing would be small or representative of a miniature heavy punching bag or a miniature peanut punching bag. The housing includes means to hang or affix the invention to a regular sized puching bag, be it a peanut punching bag or a heavy punching bag. Different sensors or sensitivities may be employed in the different housing configurations.

Table 1 illustrates some of the English language words, phonemes, and sounds which can be pre-recorded into the suspendable talking device at manufacture for a Fighting Version of the device. In this version the suspendable talking device is designed to be suspended from a separate punching bag, or other fighting practice device.

TABLE 1

English Sounds for Fighting Talking Device

| | |
|---|---|
| Three Knock-Outs - You are Out! | Good Position! Step Back and then Punch! |
| Big Shot! | Rematch! |
| Nice Body Shot! | Hold your hands up! |
| Take a Break - Tighten up your Gloves! | Who are you!? |
| Too Short! | Don't Under Estimate Me! |
| This is your Green Belt, Bruce Lee! | You need more training! |
| Cover yourself and count 1, 2, 3! | Lighten Up! |
| Load Up! | Wow am I bleeding! |
| You need more training! | You are a chicken - Quack, Quack, Quack! |
| What is the matter with you! | You are so good! |
| Don't look at me - Keep on punching! | Don't die - Hit me! |
| You are a dinosaur! | Keep on going! |
| Punch me! | It hurts! |
| I love you - please don't hit me! | Smoking is bad for you! |
| You suck! | You are drunk! |
| You are getting tired! | I am your nightmare! |
| Drinking is bad for you! | You are a good fighter! |
| Don't drink and drive! | Good job! |
| Good work! | Last round! |
| Good workout! | RING! |
| Bell Ring! | Two points for low blow! |
| You score! | I blocked you! |
| Pick it up! | Keep the pressure! |
| Easy, Killer! | Come on Grandpa! |
| Slow poke! | My Man! |
| Like a bee! | Where are you from!? |
| You lose! | Great punch! |
| What a hit! | You missed me! |
| Getting tired!? | You're the Champ! |
| Ha, Ha! | Too Slow! |
| Lucky shot! | You're crazy! |
| You want some of this!? | You win! |
| Great hook! | Give me your best shot! |
| Come on tough guy! | You are not a heavy weight - you are a fourth weight! |
| Do I look like I am playing!? | Throw them hands! |
| How dare you challenge me! | You need more practice! |
| Whimps take breaks! | Excuse me - you have Wheaties! |
| Diapers are for babies like you! | You are so strong! |
| You've been working out! | You are weak! |
| I did not even feel it! | Hey, hey, hey - that woke me up! |
| Take it easy wise guy! | Are you awake today!? |
| Did you eat today! | Aw! That hurt! |
| Go back to sleep! | You can't hit hard enough! |
| Be Good! | You hit so hard! |

TABLE 1-continued

| English Sounds for Fighting Talking Device | |
|---|---|
| I want to be your friend! | Can you be my bodyguard!? |
| Say what? Try again! | I don't know what happened to your muscles! |
| Good hit! | You got an A plus! |
| Easy, Brother! | Green light - bird singing! |
| Attack now! | You have won sixty five dollars! |
| Are you running out of gas!? | You are tough! |
| Knock it out! | Man, you are a heavyweight! |
| Don't hurt me baby! | WAAAA! (cry of a baby) |
| You are a light weight! | You have improved! |
| You are a champion! | Boo, Boo, Boo! |
| Hey, Rambo - Keep on hitting! | I start to notice you! |
| Good reflex! | Ten seconds to this round! |
| Time out! | Nice combination! |
| You got me in midsection! | Good round! |
| Sorry you lost! | Good upper cut! |
| Cheap shot! | Nice left jab! |
| Good hook! | I respect you! |
| I am not scared of you! | You landed it! |
| This is round two! | Nice target! |
| You are dangerous! | You have power! |
| You are very aggressive! | Very Good! |
| I am hit in my right eye! | Use both hands! |
| Better round! | Fight! |
| No pain - no gain! | Give me more! |
| Oh no! | That tickles! |
| Where is my teeth!? | Come on Grandma! |
| Chump! | Awesome! |
| Fantastic! | Knockout! |
| Fly like a butterfly sting! | Whimp! |
| Boring! | Go! Go! Go! |
| Don't stop! | I can't get up! |
| Get another job! | You deserve a trophy! |
| You think you are bad! | I wish I knew you along time ago! |
| Wow - you broke my nose! | Relax - I am tired! |
| Are you a boxer or a singer! | What happened to your face! |
| Don't make me cry! | One to ten! You get a three for this punch! |
| Clapping sound | Hurry up! |
| Run out of time! | Don't give up! |

Optionally, the user may select from other sounds, specific to other activities in which the user participates. Those skilled in the art will recognize that the suspendable talking device may be pre-programmed at manufacture, in any language, for a variety of user selected activities other than the Fighting Version illustrated in Table 1. Activities such as jogging, working out or holiday sayings and songs can be pre-programmed into the suspendable talking device at manufacture and sold to the consuming public for their amusement and motivation. The suspendable talking device is designed to provide motivational words and phrases which may emulate the encouragement given a user by a personal trainer. It is to be understood that the although the aforementioned example is in English, other languages may be employed.

The suspendable talking device is sensor activated employing any of several well known sensor means, including those which sense motion, light, sound or vibration. The suspendable talking device may contain recording means for the user to record sounds which are of importance to the user. One embodiment of the device may be attached to key chain. The suspendable talking device may be enclosed in a soft case or a hard case, either of which may be adorned or shaped to augment the specific user function. For example, the Fighting Version may resemble a miniature punching bag; or, a version for holiday use may resemble a tree ornament.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will form the subject matter of the claims appended hereto.

In this respect, before explaining the invention in detail, it is to be understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which this disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is an object of the present invention is to provide a suspendable talking device which is user activated, programmed and controlled for any activity that the user desires.

It is an object of the present invention to provide a suspendable talking device which will broadcast motivational speech when the onboard sensor is activated.

It is an object of the present invention to provide a suspendable talking device which may be used in conjunction with a punching bag.

It is an object of the present invention to provide a suspendable talking device which may be affixed to a belt or belt pack of a user.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiment of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawings wherein.

DESCRIPTION OF THE PREFERRED EMBODIMENT

With reference now to the drawings, a suspendable talking device of the invention embodying the principles and concepts of the present invention will be described.

Figure 1:
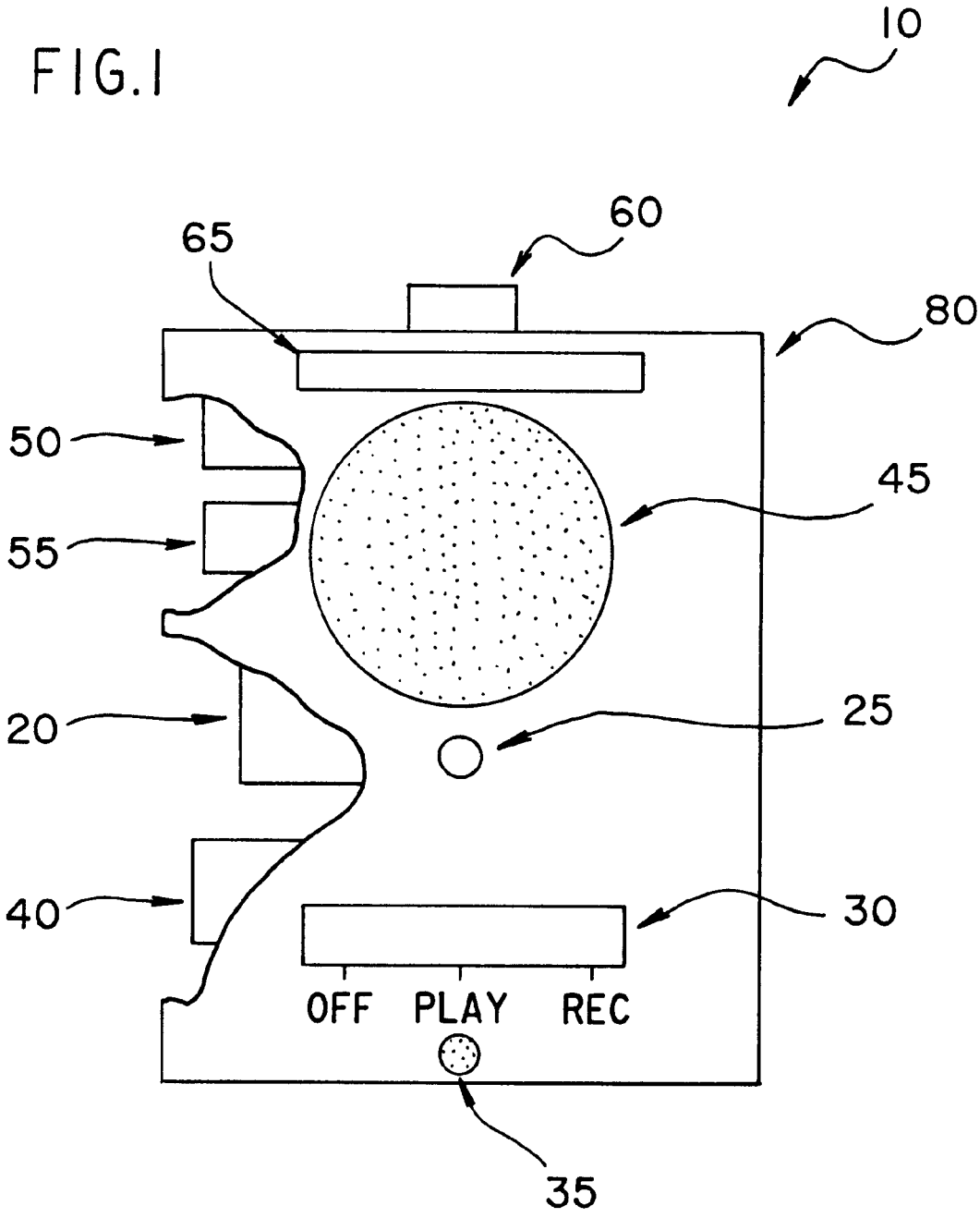
FIG. 1 is a cutaway view showing portions of the internal components and external structure of the suspendable talking device of the invention.

Turning initially to FIG. 1, there is shown the suspendable talking device of the invention generally designated by reference numeral 10. In its preferred form, suspendable talking device 10 comprises generally a case 80, equipped with a suspension means 60 attached to the case 80. Case 80 may be a hard case or a soft case, either may be decoratively adorned or shaped to suit a specific user activity. Speaker 45 is affixed inside case 80 to emanate sounds through case 80. Microphone 35 is affixed inside case 80 to allow sounds to be recorded to the sound storage means 40. Microprocessor 20 is shown in FIG. 1 residing in the case 80. The microprocessor 20 is employed to control sound recording and playing for the suspendable talking device 10. Sound storage means 40 may be accessed by a user through case 80 by any convenient means, including a hinged or screw fixed compartment, or may be unalterably affixed within case 80. Case 80 of the suspendable talking device 10 may contain a solar panel 65 for charging battery 55. The battery 55 may be recharged by the use of charging circuit 50, shown residing within case 80. Battery 55 may be removed via any conventional means from case 80. Switch 30 is illustrated as a three function switch: Off, Play, Record; and is illustrated on the front face of case 80. Sensor means 25 is activated by whatever stimulus it is sensitive to, such as motion, light, vibration or sound, when switch 30 is in the Play position. When switch 30 is in it's Record position, users may record sounds to played by allowing desired sounds proximal microphone 35.

Figure 2:
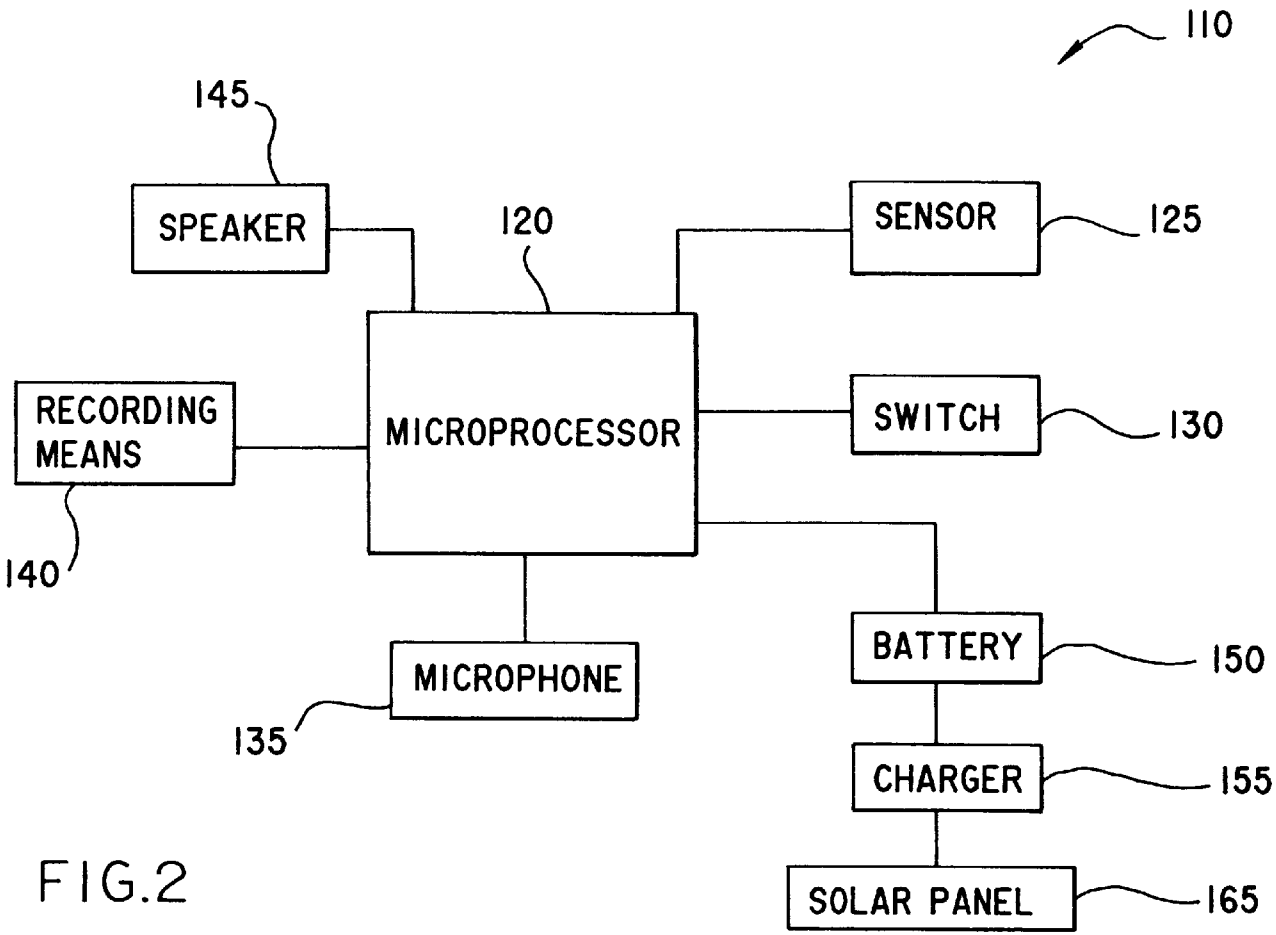
FIG. 2 is a block diagram of the suspendable talking device disclosing the relationship of the electronic components.

FIG. 2 is a block diagram of the suspendable talking device 10 shown in FIG. 1. The suspendable talking device 110 is comprised of microprocessor 120 which controls functions of talking device 110. Speaker 145, sensor 125, switch 130, microphone 135, recording storage means 140 are connected to microprocessor 120. Power is supplied to talking device 110 by battery 150, which may be charged via solar panel 165 through charging circuit 155. Switch 130 controls power to microprocessor 120, and hence, to speaker 145, sensor 125, switch 130, microphone 135, recording storage means 140. Components are fixedly secured to a case, as illustrated in FIG. 1. Means to employ the suspendable talking device 110 using AC current may be provided.

Figure 3:
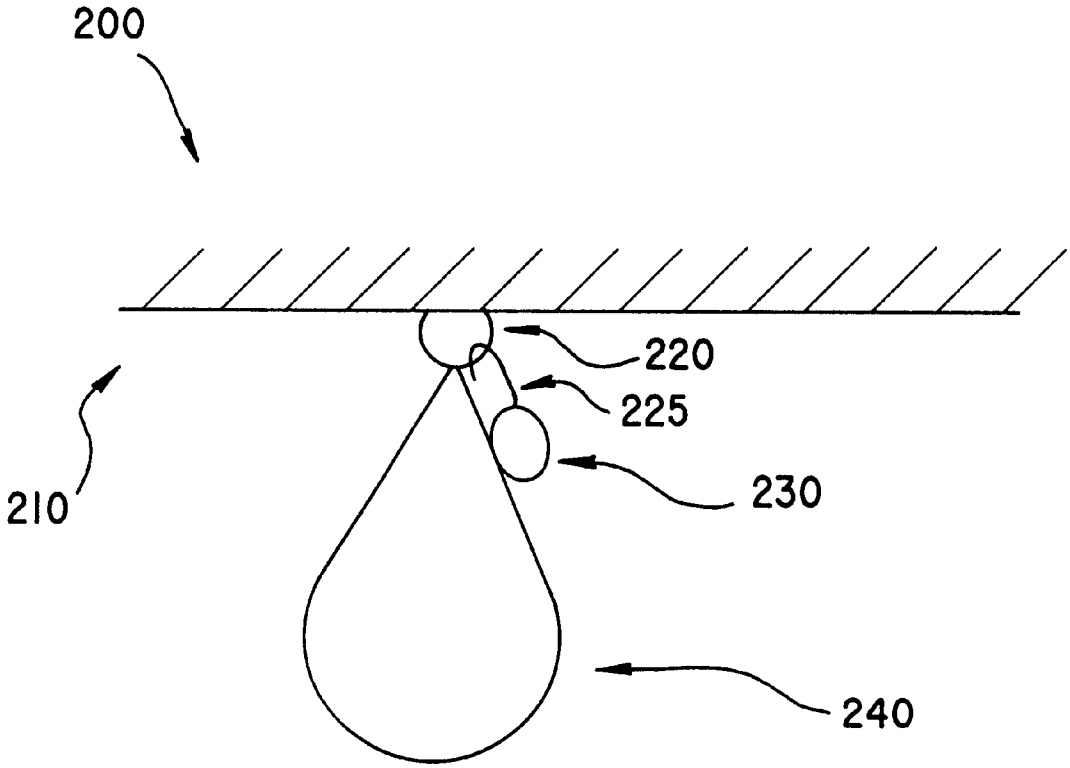
FIG. 3 is an example of a use of the suspendable talking device of the instant invention.

FIG. 3 depicts one use of suspendable talking device 10 shown in FIG. 1 and illustrated diagrammatically in FIG. 2. System 200 illustrates a punching bag 240 hung form a ceiling 210 by any conventional means 220. The suspendable talking device 225 is suspended from punching bag 240 by suspension means 220. When a user strikes punching bag 240, the sensor 125 causes the microprocessor 120 to generate a phrase or sound to send to the speaker 145. The phrase or sound may be motivational or amusing and will emanate from the speaker 145 of the suspendable talking device 225. Examples of said sounds are listed in Table 1. In the example of FIG. 3, suspendable talking device 225 has the general shape and adornment of a miniature punching bag, similar to the one from which it is suspended.

It will be recognized by those of ordinary skill in the art that punching bag 240 may be either a free-standing, floor-mounted punching bag, or, otherwise hung or supported to facilitate exercise and honing boxing or fighting skills.

It is apparent from the above that the present invention accomplishes all of the objectives set forth by providing a suspendable talking device which is user activated, programmed and controlled for any activity that the user desires.

With respect to the above description, it should be realized that the optimum dimensional relationships for the parts of the invention, to include variations in size, materials, shape, form, function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiment of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

What is claimed as being new and desired to be protected by Letters Patent of the united states is as follows:

1. A suspendable sound generating apparatus for use with a heavy punching bag comprising;

a recording storage means, a microprocessor means in communication with said recording storage means for electronically generating sounds to be played for a user, a speaker in communication with said microprocessor means for playing the sounds to a user, a microphone in communication with said microprocessor means so that a user may record sounds into said recording storage means, a sensor means in communication with said microprocessor means to allow the sounds to be toggled on and off, a power supply means, a switch having plural conditions to toggle power on or off to said microprocessor means, a switch having plural conditions to toggle power on or off to said microphone means, a switch having plural conditions to toggle power on or off to said speaker means, and a suspension means fixed to said housing, said housing having the appearance of a heavy punching bag, whereby when the user strikes the punching bag a predetermined or prerecorded sound may be prayed to amuse or exhort the user.

2. A suspendable sound generating apparatus as claimed in claim 1 wherein said recording storage means is a storage means selected from the group of magnetic tape, digital RAM, and digital ROM.

3. A suspemndable sound generating apparatus as claimed in claim 1 wherein said sensor means is selected from the group of a motion sensor, a vibration sensor, a light sensor, and a sound sensor.

4. A suspendable sound generating apparatus as claimed in claim 1 wherein said switch has a power off condition, a record-on position, and a play position.

5. A suspendable sound generating apparatus for use with a speed punching bag comprising:

a recording storage means, a microprocessor means in communication with said recording storage means for electronically generating sounds to be played for a user, a speaker in communication with said microprocessor means for playing the sounds to a user, a microphone in communication with said microprocessor means so that a user may record sounds into said recording storage means, a sensor means in communication with said microprocessor means to allow the sounds to be toggled on and off, a power supply means, a switch having plural conditions to toggle power on or off to said microprocessor means, a switch having plural conditions to toggle power on or off to said microphone means, a switch having plural conditions to toggle power on or off to said speaker means, and a suspension means fixed to said housing, said housing having the appearance of a speed punching bag; whereby when the user strikes the punching bag a predetermined or pre-recorded Sound may be played to amuse or exhort the user.

6. A suspendable sound generating apparatus as claimed in claim 5, wherein said recording storage means is a storage means selected from the group of magnetic tape, digital RAM, and digital ROM.

7. A suspendable sound generating apparatus as claimed in claim 5 wherein said sensor means is selected from the group of a motion sensor, a vibration sensor, a light sensor, and a sound sensor.

8. A suspendable sound generating apparatus as claimed in claim 5 wherein said switch has a power off condition, a record-on position, and a play position.

9. The method of employing a suspendable talking apparatus for audibly relating amusing and motivational sounds to a user comprising a shaped and adorned case which is comprised of the steps of:

(a) recording motivational or amusing sounds into the talking device, (b) suspending the talking apparatus from a device, such as a punching bag, (c) selecting play mode from a switch means incorporated on the case, (d) activating the sensor on the talking device by striking or otherwise moving or coming into proximity of the device to which the talking bag is suspended, (e) listening to the motivational or amusing sounds made by the talking device, (f) feeling an emotion from listening to the sounds emanating from the talking device.

10. The method of claim 9 wherein a sound for motivation or amusement is recorded by the user into the talking device.

* * * * *